US009103598B2

(12) United States Patent
Bellenfant et al.

(10) Patent No.: US 9,103,598 B2
(45) Date of Patent: Aug. 11, 2015

(54) HEAT EXCHANGER FOR TWO FLUIDS, IN PARTICULAR A STORAGE EVAPORATOR FOR AN AIR CONDITIONING DEVICE

(75) Inventors: Aurelie Bellenfant, Roeze sur Sarthe (FR); Claude Besombes, Ferce sur Sarthe (FR); Yannig Travert, Le Mans (FR)

(73) Assignee: VALEO SYSTEMES THERMIQUES, Le Mesnil Saint Denis, Cedex (FR)

( * ) Notice: Subject to any disclaimer, the term of this patent is extended or adjusted under 35 U.S.C. 154(b) by 1105 days.

(21) Appl. No.: 12/694,818

(22) Filed: Jan. 27, 2010

(65) Prior Publication Data

US 2010/0186934 A1 Jul. 29, 2010

(30) Foreign Application Priority Data

Jan. 27, 2009 (FR) ..... 09 00331

(51) Int. Cl.
*F28D 17/00* (2006.01)
*F28D 7/10* (2006.01)
(Continued)

(52) U.S. Cl.
CPC ..... *F28D 1/0408* (2013.01); *F28D 1/05391* (2013.01); *F28F 9/0221* (2013.01)

(58) Field of Classification Search
CPC ..... F28F 1/02; F28F 1/022; F28F 1/025; F28F 9/001; F28F 23/00; F28D 20/02; F28D 20/026; F28D 20/021; F28D 2020/0008; F28D 2020/0013; F28D 2020/006; F28D 7/0008; F28D 7/0016; F28D 7/0033; F28D 7/16
USPC ..... 165/153, 174, 152, 140, 10, 176
See application file for complete search history.

(56) References Cited

U.S. PATENT DOCUMENTS 4,002,201 A * 1/1977 Donaldson ..... 165/140
4,270,523 A * 6/1981 van Heel ..... 126/619
(Continued)

FOREIGN PATENT DOCUMENTS

DE 102004044861 A1 3/2006
DE 102006025727 A1 2/2007
(Continued)

OTHER PUBLICATIONS

English language abstract for DE 102004044861 extracted from espacenet.com database, dated May 17, 2010, 60 pages.
(Continued)

*Primary Examiner* — Allen Flanigan
*Assistant Examiner* — Jason Thompson
(74) *Attorney, Agent, or Firm* — Howard & Howard Attorneys PLLC

(57) ABSTRACT

A heat exchanger (10) includes at least one header box (12, 14) delimiting a first chamber (42) for a first fluid ($F_1$) and a second chamber (44) for a second fluid ($F_2$), as well as a beam of tubes (16) ending into the header box (12, 14) and comprising at least one first tube (18) communicating with the first chamber (42) of the collecting box (12, 14) and at least one second tube (20) communicating with the second chamber (44) of the collecting box, the first tube (18) being coupled with the second tube (20) to constitute a module (22) allowing a heat transfer between the first tube (18) and the second tube (20). The ends (32) of the first tube (18) is off-set with respect to the ends (30) of the first tube (18), so that such ends (30, 32) can be received in an alternate way in insertion holes (34) of the header box (2, 14), said holes (34) being spaced with a constant step (P).

22 Claims, 5 Drawing Sheets

(51) Int. Cl.

| | |
|---|---|
| ***F28D 1/02*** | (2006.01) |
| ***F28D 1/04*** | (2006.01) |
| ***F28D 1/053*** | (2006.01) |
| ***F28F 9/02*** | (2006.01) |

(56) References Cited

U.S. PATENT DOCUMENTS

| | | | | |
|---|---|---|---|---|
| 5,241,839 | A * | 9/1993 | Hughes | 62/515 |
| 5,884,696 | A * | 3/1999 | Loup | 165/140 |
| 6,935,414 | B2 * | 8/2005 | Kawakubo et al. | 165/164 |
| 6,986,385 | B1 * | 1/2006 | Gilles et al. | 165/202 |
| 7,156,156 | B2 * | 1/2007 | Haller et al. | 165/10 |
| 7,318,470 | B2 | 1/2008 | Demuth et al. | |
| 7,571,761 | B2 * | 8/2009 | Katoh et al. | 165/174 |
| 8,210,246 | B2 * | 7/2012 | Bhatti et al. | 165/140 |
| 2004/0093889 | A1 | 5/2004 | Bureau et al. | |
| 2006/0266501 | A1 * | 11/2006 | So et al. | 165/140 |
| 2007/0039714 | A1 | 2/2007 | Loup et al. | |
| 2009/0095015 | A1 * | 4/2009 | Kerler et al. | 62/524 |
| 2009/0120626 | A1 | 5/2009 | Rajagopalan et al. | |
| 2014/0174703 | A1 * | 6/2014 | Yoshioka et al. | 165/173 |

FOREIGN PATENT DOCUMENTS

| | | | |
|---|---|---|---|
| DE | 102006042789 | A1 | 3/2008 |
| EP | 1424531 | A2 | 6/2004 |
| EP | 2060420 | A1 | 5/2009 |
| FR | 2793015 | A1 | 11/2000 |
| FR | 2861166 | A1 | 4/2005 |
| FR | 2863044 | A1 | 6/2005 |
| WO | WO 03054467 | A1 | 7/2003 |
| WO | WO 2006059005 | A1 * | 6/2006 |

OTHER PUBLICATIONS

English language abstract for DE 102006025727 extracted from espacenet.com database, dated May 17, 2010, 15 pages.
English language abstract for DE 102006042789 extracted from espacenet.com database, dated May 17, 2010, 13 pages.
English language abstract for EP 1424531 extracted from espacenet.com database, dated May 17, 2010, 14 pages.
English language abstract for EP 2060420 extracted from espacenet.com database, dated May 17, 2010, 14 pages.
English language abstract for FR 2793015 extracted from espacenet.com database, dated May 17, 2010, 14 pages.
English language abstract for FR 2861166 extracted from espacenet.com database, dated May 17, 2010, 35 pages.
English language abstract for FR 2863044 extracted from espacenet.com database, dated May 17, 2010, 39 pages.
English language abstract for WO 03054467 extracted from espacenet.com database, dated May 17, 2010, 101 pages.
INPI Institut National De La Propriete Industrielle Search Report for FA 717231 / FR 0900331, dated Aug. 7, 2009, 1 page.

* cited by examiner

HEAT EXCHANGER FOR TWO FLUIDS, IN PARTICULAR A STORAGE EVAPORATOR FOR AN AIR CONDITIONING DEVICE

RELATED APPLICATIONS

This application claims priority to and all the advantages of French Patent Application No. FR 09/00331, filed on Jan. 27, 2009.

The invention relates to heat exchangers, in particular for motor vehicles.

It relates more specifically to a heat exchanger including two collection boxes opposite one another each delimiting a first chamber for a first fluid and a second chamber for a second fluid, as well as a core of tubes inserted between the two collection boxes and comprising first tubes communicating with the first chambers of the two collection boxes and second tubes communicating with the second chambers of the two collection boxes, in which each first tube is joined to a second tube so as to form a module enabling heat exchange between the first tube and the second tube, in which the modules are stacked and mutually spaced apart so as to enable a third fluid to pass, which washes over the core of tubes.

Such a heat exchanger can be part of a heating, ventilation and/or air conditioning device, in particular for a motor vehicle, as taught, for example, by the publication FR 2 861 166.

In this particular use in motor vehicles, the heat exchanger can be, for example, an air conditioning evaporator through which a refrigerant passes so as to cool the air flow and produce cooled air sent into the vehicle interior.

The heat exchanger can also be a heating radiator through which a warm fluid passes, normally installed in the cooling loop of the vehicle engine, so as to heat the air flow and produce warm air sent into the vehicle interior.

In the aforementioned type of heat exchanger, the first fluid, which is the refrigerant or heat transfer fluid, can exchange heat with a second fluid, which is an accumulation fluid, while the third fluid, which washes over the core, is formed by the air flow to be sent into the vehicle interior.

In the case of a classic air conditioning circuit, the fluid is a refrigerant, which, in the following order, passes through: a compressor, a condenser or a gas cooler according to the refrigerant used, an expansion valve and an evaporator, before returning to the compressor. In the evaporator, the refrigerant changes from a liquid phase or a liquid/vapor phase to a vapor phase by receiving heat from the air flow, which is thus cooled. Such a circuit is classically passed through by a refrigerant consisting of a fluorinated hydrocarbon such as that known by the designation R 134A.

Air conditioning circuits passed through by a refrigerant operating according to a supercritical cycle, such as, for example, carbon dioxide ($CO_2$) are also known.

A disadvantage of the known evaporators is that their capacity to cool the air flow is dependent on the operation of the compressor and the circulation of the refrigerant in the air conditioning circuit. In other words, the air flow is no longer cooled once the compressor is stopped.

In most motor vehicles, the compressor is driven by means of the engine and is therefore stopped once the engine has stopped.

Currently, to meet in particular anti-pollution standards, motor vehicles are being produced so as to ensure that the internal combustion engine stops when the vehicle is in neutral gear or stopped, and as the internal combustion engine is stopped, the air conditioning is also stopped. The stopping of the internal combustion engine has the effect of stopping the compressor and therefore stopping the circulation of refrigerant in the air conditioning circuit. This results in discomfort for the passenger(s) of the vehicle due to an absence of an air conditioned air flow after several seconds of blowing.

A similar problem may occur if the heat exchanger is a heating radiator, due to the fact that the heat transfer fluid is caused to circulate by a pump, which is classically driven by the internal combustion engine of the vehicle. Thus, the stopping of the engine causes the pump to stop and therefore the circulation of fluid to stop. This results in discomfort, especially when the outside temperature is very low.

In a heat exchanger of the type mentioned in the introduction, the presence of a second fluid, which is an accumulation fluid, enables these disadvantages to be avoided.

Indeed, this second fluid enables accumulation either of cold (by consequently releasing heat), or of heat, when the engine of the vehicle is operating and of restoring this cold or this heat, in the vehicle interior, when the engine is stopped.

FR 2 863 044 describes a heat exchanger that operates on the same principle with an accumulation fluid, but in which a single collection box is provided and each of the modules includes two U-shaped tubes.

The heat exchangers according to the publications FR 2 861 166 and FR 2 863 044 are generally satisfactory, but the methods of assembly thereof present problems of inserting tubes in the collection box(es).

In addition, the production of collection boxes requires a large number of components in order to enable the first fluid and the second fluid to be distributed.

The invention is intended in particular to overcome the aforementioned disadvantages.

It thus proposes a heat exchanger of the type defined in the introduction, in which the first tube and the second tube forming a module are in contact over their entire length, the second tube has ends offset with respect to the ends of the first tube, so that the ends of the first tubes and the ends of the second tubes can be received alternately in insertion holes of the collection box, spaced apart by a constant pitch.

Thus, in a single module, the first and second tubes are joined so as to enable an exchange of heat between the first fluid and the second fluid that they contain, but the ends of the second tube are curved and offset, i.e. off-centered, with respect to the corresponding ends of the first tube, which off-centering corresponds to the pitch of the insertion holes of the collection boxes. The modules can thus be stacked and inserted between the two collection boxes, with the latter having insertion holes spaced two-by-two with a constant pitch.

In other words, a first tube of a module can be inserted into an insertion hole adjacent to another insertion hole, which receives the end of a second tube of an adjacent module.

According to another feature of the invention, the first tube has a rectilinear body from one to the other of its ends. Moreover, the second tube has a rectilinear body, in particular ending with two bent and offset ends. Advantageously, the ends of the second tube are bent in the form of a bayonet.

In another preferred embodiment of the invention, the collection box comprises a collection plate in which the insertion holes are provided for the first and second tubes, a second distribution plate arranged against the collection plate, forming a stop for the ends of the second tubes, delimiting the second chamber in fluid communication with the second tubes, and comprising openings for the ends of the first tubes, a first distribution plate arranged against the second distribution plate, forming a stop for the ends of the first tubes delimiting the first chamber in fluid communication with the first tubes, and a closing assembly arranged against the first distribution plate, opposite the second distribution plate.

Thus, the collection box is formed by at least four components, namely, in series: the collection plate, the second distribution plate, the first distribution plate and the closing assembly.

Although this closing assembly can be produced as a single piece, it is preferable for it to include an intermediate plate arranged against the first distribution plate and a lid covering the first distribution plate and jointly defining chambers for distributing the first fluid in the first distribution plate according to a defined path.

In the following description, provided solely as an example, reference is made to the appended drawings, in which.

Figure 1:
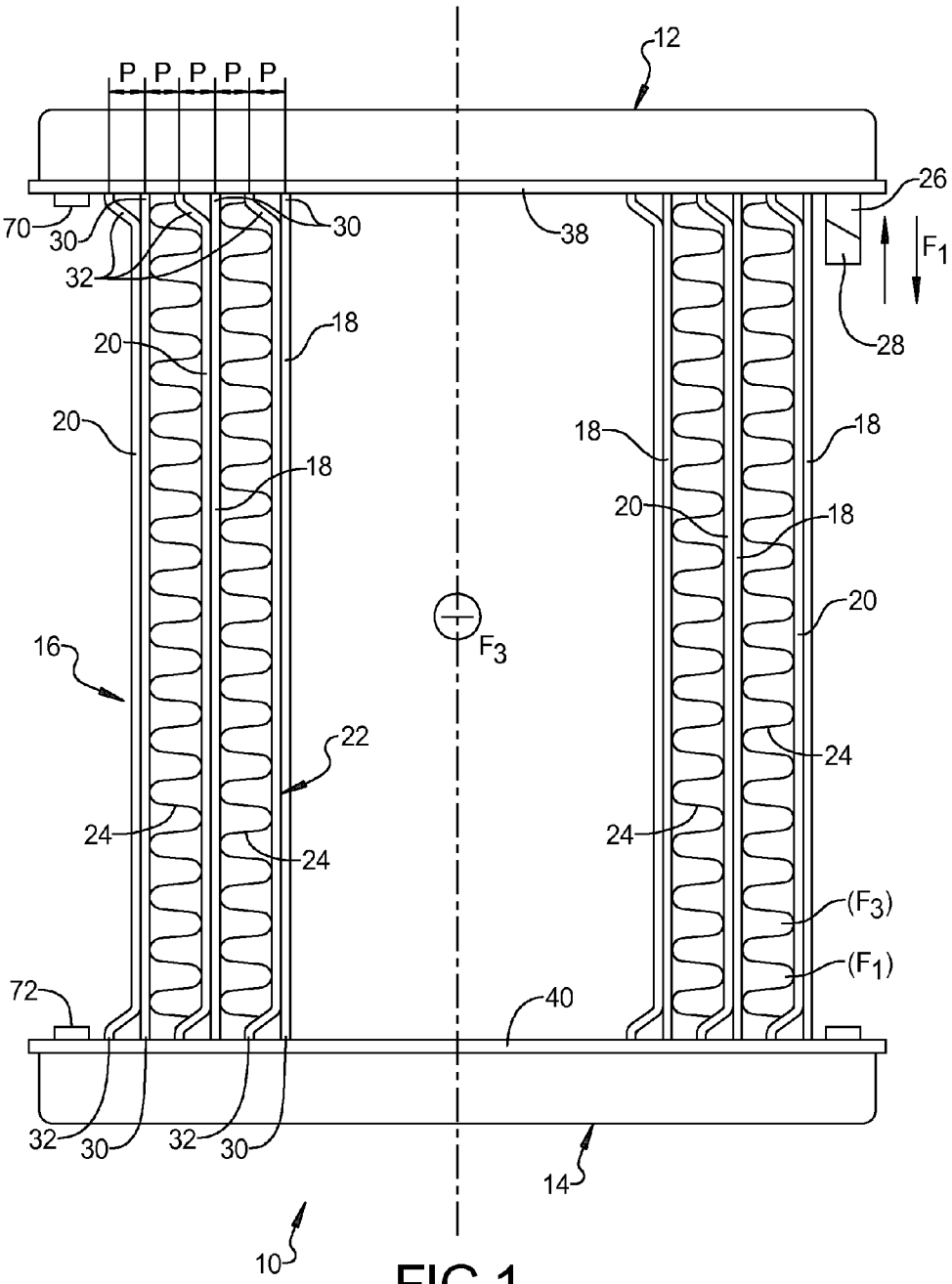
FIG. 1 is a frontal view of a heat exchanger according to this invention.
Figure 4:
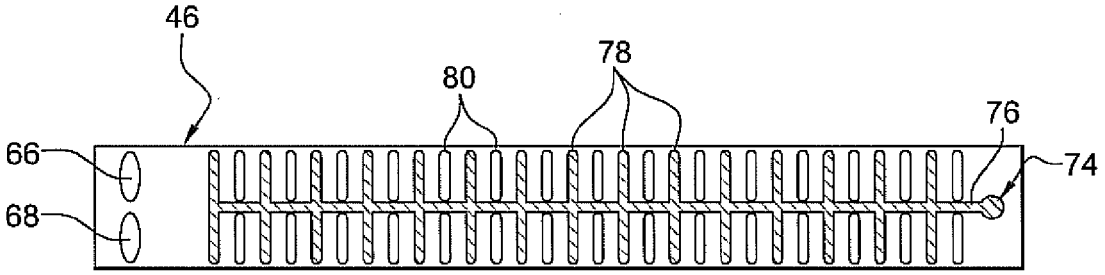
Figure 5:
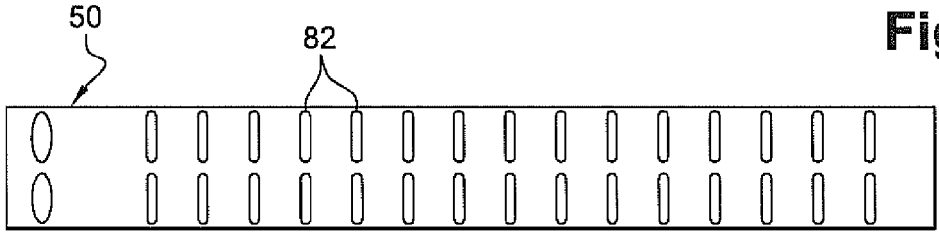
Figure 6:
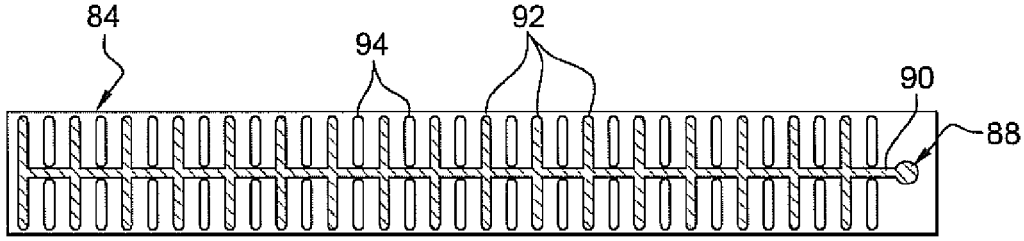
Figure 7:
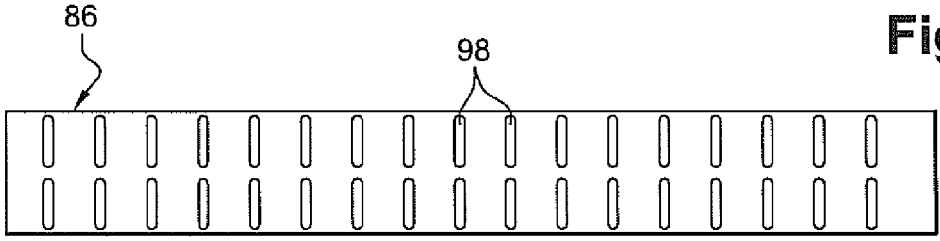
Figure 9:
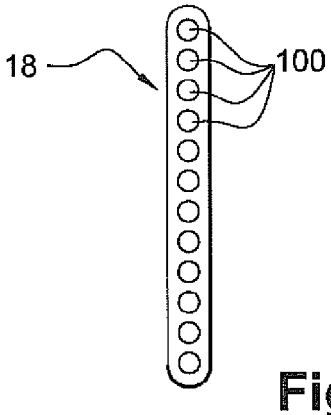
Figure 10:
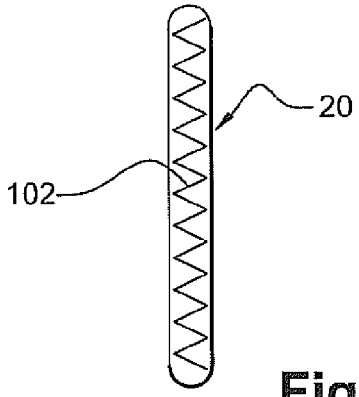

FIGS. 4 and 5 respectively show the second distribution plate and the first distribution plate of one of the collection boxes of the heat exchanger of FIG. 1;

FIGS. 6 and 7 respectively show the second distribution plate and the first distribution plate of the other of the collection boxes of the heat exchanger of FIG. 1;

FIGS. 8*a* to 8*d* diagrammatically show four successive steps of assembly of the heat exchanger of FIG. 1;

FIG. 9 is a cross-section view of a first tube of the heat exchanger of FIG. 1; and FIG. 10 is a cross-section view of a second tube of the heat exchanger of FIG. 1.

The following detailed description refers to a heat exchanger produced in the form of an air conditioning evaporator enabling an accumulation fluid to be stored, with the understanding that the invention is not limited to this particular use and also covers, in particular, heating radiators.

The heat exchanger 10 shown in FIG. 1 includes two mutually opposite collection boxes 12 and 14, in this case respectively referred to as the upper collection box 12 and the lower collection box 14 for the sake of convenience.

Between the two collection boxes 12 and 14, a core 16 is inserted, which forms the core of the heat exchanger 10 and which includes first tubes 18 and second tubes 20. Each first tube 18 is joined to a second tube 20 in order to jointly form a module 22.

Corrugated spacers 24 form disruptors and area arranged between two adjacent modules 22 so as to increase the surface for heat exchange with a fluid washing over the core 16, in particular an air flow.

The first tubes 18 are suitable for being passed through by a first fluid $F_1$, which, in the example considered, consists of a refrigerant. The second tubes contain a second fluid $F_2$, which, in the example considered, consists of an accumulation fluid and more specifically a cold accumulation fluid. Finally, the core is washed over by a third fluid $F_3$, which is air and which passes between the modules 22 at the level of the corrugated spacers 24.

The second fluid $F_2$ can be static in the second tubes 20 or circulate in the second tubes 20, which are then coupled to a circulation loop of the second fluid $F_2$.

The first fluid $F_1$ circulates in the heat exchanger 10 from an inlet manifold 26 to an outlet manifold 28, which, in the example, are connected to the collection box 12. According to the example embodiment of FIG. 1, the second fluid $F_2$ remains stored in the heat exchanger.

Figure 2:
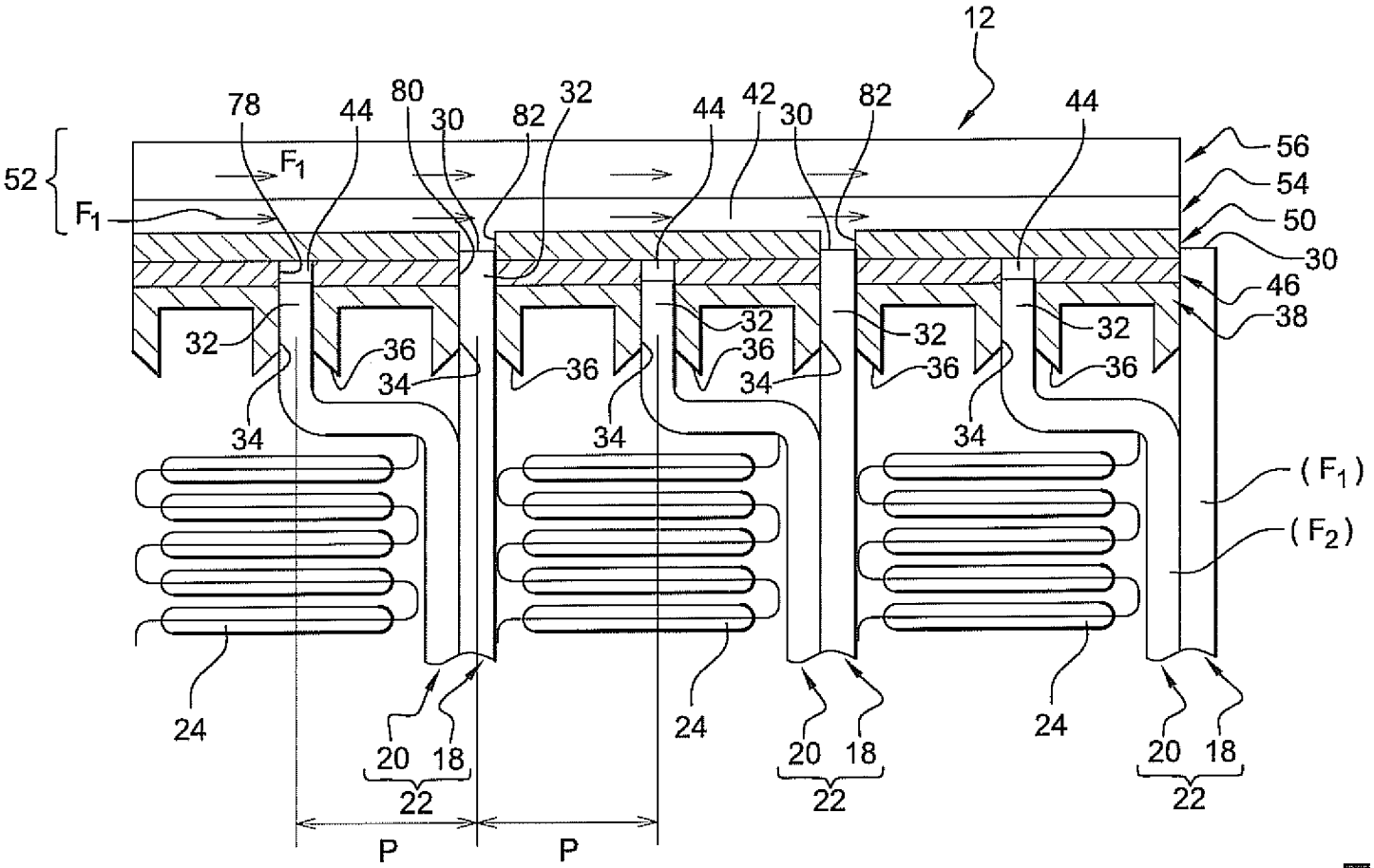
FIG. 2 is a partial diagrammatic cross-section view of the heat exchanger of FIG. 1.

As can be seen in FIGS. 1 and 2, in a module 22, the first tube 18 and the second tube 20 have substantially identical shapes. The first tube 18 and the second tube 20 comprise two large faces arranged parallel to one another. The large faces of the first tubes 18 and second tubes 20 are joined to one another by small faces.

The first tube 18 and the second tube 20 are in contact over their entire lengths, along one of their respective large faces. Each first tube 18 in this case has a rectilinear body from one to the other of its ends 30.

However, the second tube 20 has ends 32, which are off-centered with respect to the ends 30 of the first tube 18. In particular, the ends 32 of the second tube 20 are curved and offset.

Thus produced, the ends 30 of the first tubes 18 and the ends 32 of the second tubes 20 can be received alternately in insertion holes 34 arranged respectively in the collection boxes 12 and 14. The insertion holes 34 of the collection box 12 are shown in FIG. 2, with the understanding that the collection box 14 comprises similar insertion holes.

FIG. 2 shows the insertion holes 34 spaced two-by-two with a constant pitch P, also shown in FIG. 1.

The insertion holes 34 are each surrounded by a collar 36. The collar 36 preferably comprises a lower chamfer in order to facilitate the simultaneous insertion of the ends 30 and 32 of the first and second tubes 18 and 20 into the respective insertion holes 34.

The insertion holes 34 and the collars 36 are formed in a collection plate 38 of the upper collection box 12. The lower collection box 14 has a similar collection plate 40, as shown in FIG. 1, including similar insertion holes 34 and collars 36 (not shown). The ends 32 of each of the second tubes 20 are offset with respect to the ends 30 of the first tube 18. In particular, the ends 32 of the second tube 20 are deformed and curved so as to obtain an offset or off-centering similar to that described above.

Advantageously, the offset or off-centering of the ends 32 of the tubes 20 is produced by a double-bend in the form of a bayonet. Thus, each end 32 of the second tube 20 extends in a direction parallel to the axial direction of the body of the actual second tube 20.

The collection box 12 delimits a first chamber 42 for circulation of the first fluid $F_1$, which communicates with the respective ends of the first tubes 18 and a second chamber 44 for circulation of the fluid $F_2$, which communicates with the respective ends of the second tubes 20. The collection box 14 comprises similar chambers.

The term "chamber" as used here refers to an internal volume that can be made in a single piece or a plurality of pieces and that is suitable for containing a fluid communicating with the ends of the corresponding tubes.

In the example, the second fluid is an accumulation or storage fluid, which is immobile, and the heat exchanger thus performs a static storage function. However, it is possible for the second fluid to be in movement so as to perform a dynamic storage function.

The structure of the collection box 12 will now be described more specifically in reference to FIGS. 2 and 3, with the understanding that the structure of the collection box 14 is identical to the collection box 12.

As already indicated, the collection box 12 comprises a collection plate 38 in which the insertion holes 34 are provided for the passage of the respective ends 30 and 32 of the first and second tubes 18 and 20.

A second fluid $F_2$ distribution plate 46, or second distribution plate 46, is arranged against the collection plate 38 and forms stops for the ends 32 of the second tubes 20. The distribution plate 46 ensures the distribution of the second fluid $F_2$. The second fluid $F_2$ distribution plate 46 thus comprises second openings 78, which jointly delimit the second chamber 44 and into which the ends 32 of the second tubes 20 lead. In addition, the distribution plate 46 of the second fluid $F_2$ comprises first openings 80 for the passage of the ends 30 of the first tubes 18.

Another first fluid $F_1$ distribution plate 50, or first distribution plate 50, is placed against distribution plate 46. The first fluid $F_1$ distribution plate 50 forms stops for the ends 30 of the first tubes 18. The distribution plate 50 ensures the distribution 50 of the first fluid $F_2$. The first fluid $F_1$ distribution plate 50 simultaneously delimits the first chamber 42. The distribution plate 50 of the first fluid $F_1$ thus comprises openings 82 that jointly delimit the first chamber 42 and into which the ends 30 of the first tubes 18 lead.

The first fluid $F_1$ distribution plate 50 is superimposed by a closing assembly 52 arranged against the first distribution plate 50 of the first fluid $F_1$. The lid assembly 52 is arranged opposite the distribution plate 46 of the second fluid $F_2$.

According to the example shown, the closing assembly 52 includes an intermediate plate 54 and a lid 56.

This arrangement is such that the first tubes 18 communicate with the first chamber 42, while the second tubes 20 communicate with the second chamber 44. This enables fluid communication to be ensured in every case.

Figure 3:
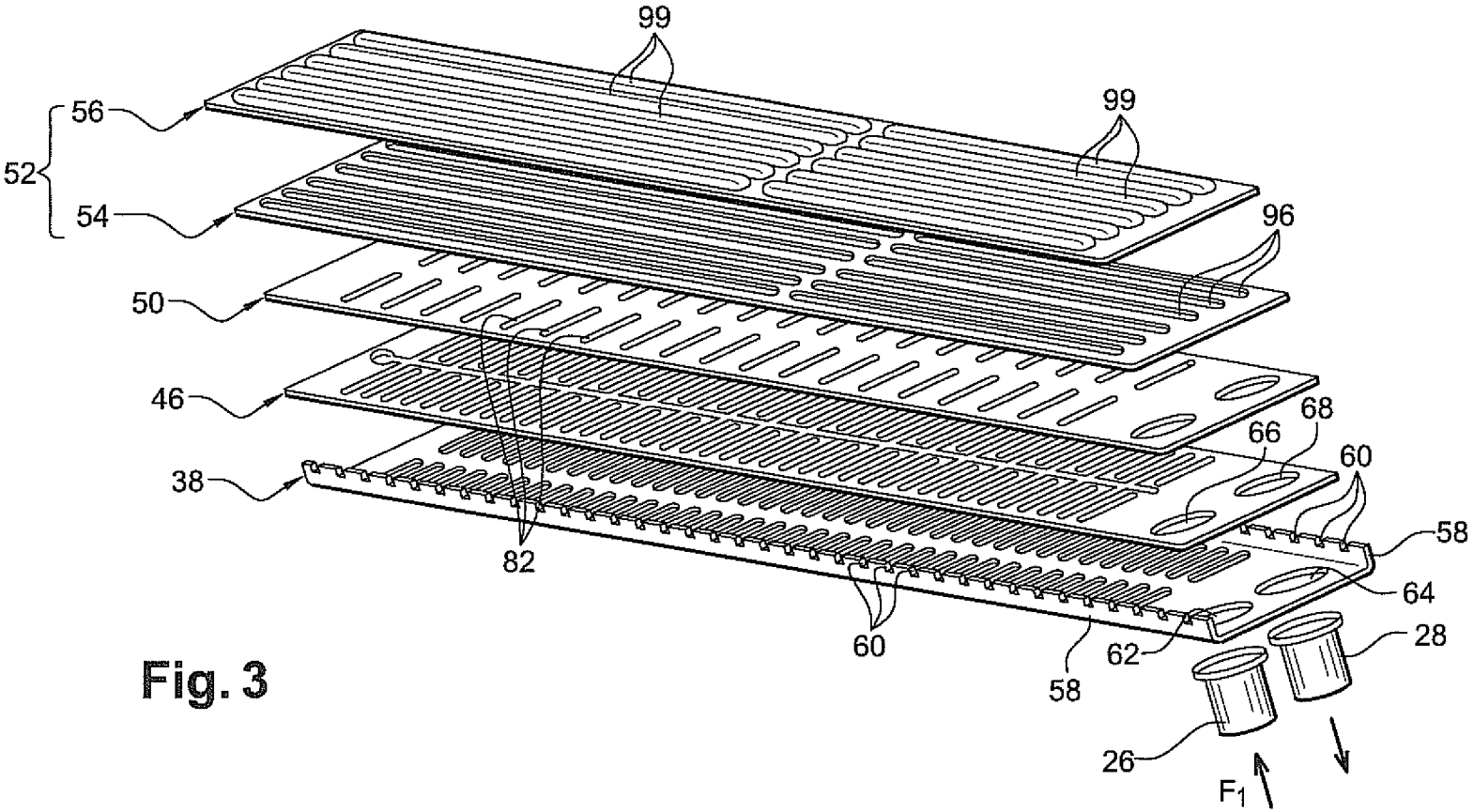
FIG. 3 is an exploded perspective view of one of the collection boxes of the heat exchanger of FIG. 1.

The structure of the collection box 12 can be better understood by considering the exploded view of FIG. 3. The collecting plate 38 comprises two rows of insertion holes 34 capable of receiving two rows of modules 22 and therefore two rows alternately including first tubes 18 and second tubes 20.

The collecting plate 38 comprises two longitudinal raised edges 58 equipped with clamping tabs 60 suitable for being folded back against the respective peripheral edges of the lid 56 in order to hold all of the elements forming the collection box 12 mutually clamped.

The inlet 26 and outlet 28 manifolds respectively define a first inlet and a first outlet for the first fluid $F_1$. The inlet 26 and outlet 28 manifolds communicate with the first chamber 42 of the collection box 12 through the collecting plate 38 and the first fluid $F_1$ distribution plate 46.

Alternatively, according to another embodiment, it is possible for the inlet 26 and outlet 28 manifolds to be arranged respectively in collection box 12 and collection box 14.

According to this embodiment, the first inlet 26 and the first outlet 28 are arranged on the same collection box 12 and they communicate with the first chamber 42 of the collection box 12 through openings 62 and 64 arranged in the collecting plate 38 and through openings 66 and 68 of the first fluid $F_1$ distribution plate 46.

In addition, the collection boxes 12 and 14 respectively have a second inlet 70 and a second outlet 72, shown in FIG. 1, to enable the integration of the second fluid $F_2$ in the heat exchanger 10. The second inlet 70 and the second outlet 72 communicate with at least one of the second chambers 44 through at least one of the collecting plates 38 and 40.

According to the example embodiment, the second inlet 70 and the second outlet 72 are respectively arranged in the collecting plates 38 and 40. The second inlet 70 and the second outlet 72 are holes that will then be closed so as to enable immobilization of the second fluid, which is an immobile fluid as already described.

FIG. 4 shows the structure of the second fluid $F_2$ distribution plate 46 of the collection box 12. The second fluid $F_2$ distribution plate 46 has a general rectangular shape and comprises, at one of its ends, openings 66 and 68 for the passage of the first fluid $F_1$. The second fluid $F_2$ distribution plate 46 also comprises an inlet opening 74 for introduction of the second fluid $F_2$, which communicates with the second inlet 70.

The inlet opening 74 leads into a longitudinal channel 76 supplying the second openings 78 so as to jointly define the second chamber 44. In a particularly advantageous manner, the longitudinal channel 76 is arranged in the central portion of the second fluid $F_2$ distribution plate 46. The longitudinal channel 76 constitutes an axis of symmetry of the second fluid $F_2$ distribution plate 46. Such an arrangement enables the second openings 78 to be arranged on either side of the longitudinal channel 76.

The second openings 78 are arranged so as to alternate with the first openings 80 through which the ends 30 of the first tubes 18 pass.

Advantageously, the first and second openings 80 and 78 are openings of which the shape corresponds respectively to the cross-section of the first and second tubes 18 and 20. According to the example embodiment, the first and second openings 80 and 78 have an oblong shape. Preferably, the first and second openings 80 and 78 are arranged according to two parallel rows.

FIG. 5 shows the first fluid $F_1$ distribution plate 50, which is associated with the second fluid $F_2$ distribution plate 46 in FIG. 4. The first fluid $F_1$ distribution plate 50 comprises openings 82 for the passage of the first fluid $F_1$, which communicate respectively with the first openings 80 of the second fluid $F_2$ distribution plate 46, which is associated with it. The openings 82 of the first fluid $F_1$ distribution plate 50 are openings of which the shape corresponds respectively to the cross-section of the first tubes 18. According to the example embodiment, the openings 82 of the first fluid $F_1$ distribution plate 50 have an oblong shape. The openings 82 are arranged according to two parallel rows.

FIG. 4 diagrammatically shows, with hatched lines, the areas occupied by the second fluid $F_2$. The areas occupied by the first fluid $F_1$ are not hatched in FIG. 4 or in FIG. 5.

FIGS. 6 and 7 respectively show a second fluid $F_2$ distribution plate 84 and a first fluid F1 distribution plate 86 of collection box 14, opposite collection box 12.

The second fluid $F_2$ distribution plate 84 of collection box 14 has a structure similar to that of the second fluid $F_2$ distribution plate 46 of collection box 12. It also includes an opening 88 that supplies a longitudinal channel 90 supplying second openings 92 so as to define a second chamber.

In a particularly advantageous manner, the longitudinal channel 90 is arranged in the central portion of the second fluid $F_2$ distribution plate 84. The longitudinal channel 90 constitutes an axis of symmetry of the second fluid $F_2$ distribution plate 84. Such an arrangement enables the second openings 78 to be arranged on either side of the longitudinal channel 76.

The second openings 92 are arranged so as to alternate with the first openings 94 for the first fluid $F_1$, through which the ends 30 of the first tubes 18 pass.

As in FIG. 4, the areas occupied by the second fluid $F_2$ are shown with hatched lines, while the areas occupied by the first fluid $F_1$ are not hatched.

The first distribution plate 86, shown in FIG. 7, has openings 98 for the first fluid $F_1$, which communicate respectively with the first openings 94 of the distribution plate 84 of the second fluid $F_2$, which is associated with it. The openings 98 are arranged according to two parallel rows.

The openings 92, 94 and 98 of the second fluid $F_2$ distribution plate 84 and the first fluid $F_1$ distribution plate 86 are openings of which the shape corresponds respectively to the cross-section of the first tubes 18 and the second tubes 20. According to the example embodiment, the openings 92, 94 and 98 have an oblong shape.

The intermediate plate 54 and the lid 56, as shown in FIG. 3, of the collection box 12 are arranged so as to define different circulation paths for the first fluid $F_1$. In this case, the intermediate plate 54 includes the elongate channels 96 and the lid 56 includes elongate protuberances 99 corresponding with the elongate channels 96 so as to define circulation passages in the longitudinal direction of the collection box 12.

The collection box 14 includes similar arrangements. Owing to these arrangements, the first fluid $F_1$ is enabled to circulate in a first layer according to a U-path, then in a second layer according to a second U-path, as is well known in the field of evaporators.

FIGS. 8*a* to 8*d* show the various steps of assembling a heat exchanger 10 according to this invention.

Figure 8A:
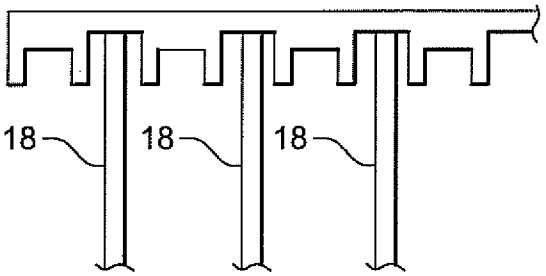

In a first step, the core 16 is formed by positioning a first series of first tubes 18 (FIG. 8*a*).

Figure 8B:
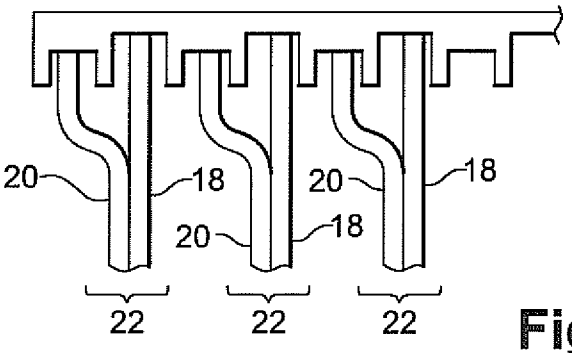

In a second step, a first series of second tubes 20 are positioned, of which the ends have previously been curved so as to be offset with respect to the body of the second tube 20 (FIG. 8*b*).

Figure 8C:
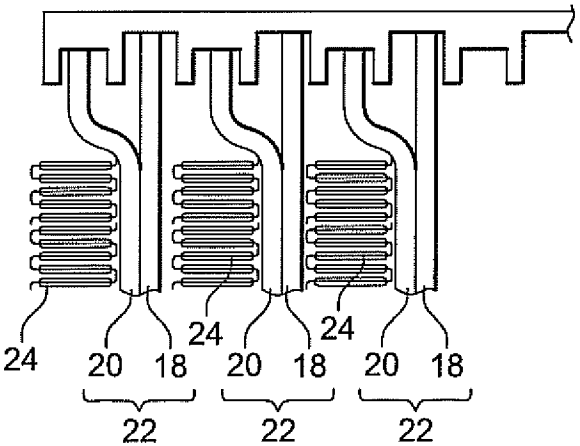
Figure 8D:
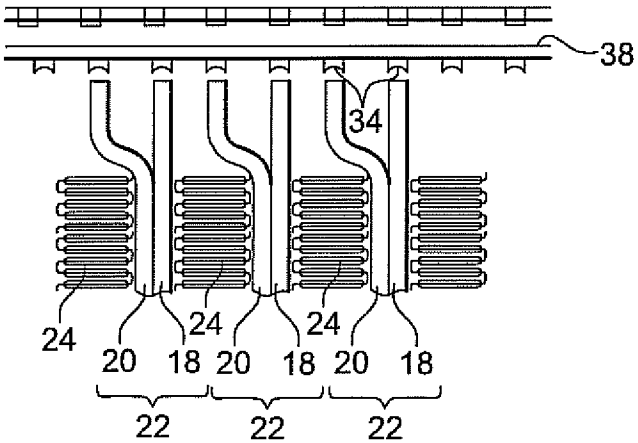

The third step consists of placing the corrugated spacers 24 between two adjacent modules 22 (FIG. 8*c*).

In the fourth step, the core is compressed in the direction of the stack so that the ends 30 and 32 of the tubes 18 and 20 are spaced apart by the desired pitch P, i.e. corresponding to the pitch of the insertion holes 34 of the two collection boxes 12 and 14.

Finally, in a fifth step (FIG. 8*d*), the ends 30 and 32 of the tubes 18 and 29 are simultaneously introduced into the insertion holes 34 of the two collection boxes 12 and 14 previously assembled. This operation is performed by bringing the two collection boxes 12 and 14 together in the direction of the core 16 in the direction of the tubes 18 and 20.

According to the assembly method described above, the two rows of modules 22 are mounted simultaneously and a single spacer 24 is inserted between two adjacent modules 22 in the direction of the thickness of the core 16, i.e. the direction of the fluid $F_3$.

Alternatively, it is possible to create two half-cores corresponding to each of the rows of tubes 18 and 20. In this case, the corrugated spacer 24 is interrupted. It is thus possible to create a first half-core, which will be joined to a second similar half-core in order to define the heat exchanger 10. Such a method is particularly advantageous if the collection boxes 12 and 14 are formed in two parts.

The various components of the heat exchanger 10 are advantageously made of aluminum or an aluminum-based alloy so as to enable the assembly thereof by brazing in a single operation in a suitable brazing oven.

The structure of the collection boxes 12 and 14, obtained by assembling a plurality of superimposed plates, enables high resistance to be provided in particular when the refrigerant is a $CO_2$-type fluid, which operates in a supercritical cycle at high pressures, on the order of 150 bars. It is indeed necessary for the various components to be capable of resisting high bursting pressures, on the order of 300 bars.

In the example above, the fluid can be a supercritical fluid, in particular carbon dioxide ($CO_2$) also known as R744, or a sub-critical fluid, in particular a fluorinated compound, in particular the coolant referenced R134a. In addition, this invention can be used with other alternative fluids.

Moreover, this structure makes it possible to maintain an overall profile similar to that of comparable evaporators of the prior art.

As shown in FIG. 9, the first tube 18 can be produced by extrusion and comprise a plurality of channels 100, which in particular resist high refrigerant pressures. For the second tube 20 intended to be passed through by the heat transfer fluid, it is possible to use a flat tube as shown in FIG. 10. The second tube 20 can optionally receive, at its interior, a corrugated blade 102 so as to ensure the thermal bridge function.

Of course, the structure of the tube will each time be adapted to the corresponding fluid type. Preferably, tubes with an oblong cross-section having two opposite flat faces enabling the corrugated spacers to be brazed will be used.

When the heat exchanger of the invention is a storage evaporator for a second fluid constituting an accumulation fluid, advantageously having a melting point of between 0 and 10° C., preferably between 4 and 8° C., the second fluid advantageously has a melting enthalpy of at least 150 kJ/kg. The second fluid can advantageously be chosen from tetradecane, paraffins, hydrated salts and eutectic mixtures.

The invention is not limited to the particular use in a storage evaporator as described specifically as an example. It applies to other types of heat exchangers, in particular heating radiators for motor vehicle interiors.

Moreover, the example described above is a heat exchanger equipped with two collection boxes. It is possible to envisage a heat exchanger equipped with a single collection box associated with so-called U-fluid circulation tubes. When multiple rows of tubes are provided in the core, the circulation can occur in a U-form, i.e. the circulation of the fluid entering two tubes opposite one another occurs in opposite directions, or in an I-form, i.e. the circulation of the fluid in two tubes opposite one another occurs in the same direction.

Of course, the invention is not limited to the embodiments described above and provided solely as an example, and encompasses other alternatives that a person skilled in the art may consider in the context of the claims and in particular any combination of the various embodiments described above.

The invention claimed is:

1. A heat exchanger (10) including at least one collection box (12, 14) delimiting a first chamber (42) for a first fluid ($F_1$) and a second chamber (44) for a second fluid ($F_2$), as well as a core (16) of tubes (18, 20) leading into the at least one collection box (12, 14) and comprising at least one first tube (18) communicating with the first chamber (42) of the collection box (12, 14) and at least one second tube (20) communicating with the second chamber (44) of the collection box (12, 14), in which the at least one first tube (18) is joined to the at least one second tube (20) to form a module (22) enabling an exchange of heat between the at least one first tube (18) and the at least one second tube (20), in which the core (16) includes at least two modules (22) stacked and spaced apart so as to enable a third fluid ($F_3$) passing through the core (16) of tubes (18, 20), characterized in that the at least one first tube (18) and the at least one second tube (20) of each module (22) each have two faces that are larger than two other faces, and wherein one of the larger faces of the at least one first tube (18) is joined to one of the larger faces of the at least one second tube (20) such that the joined larger faces of the at least one first tube (18) and the at least one second tube (20) are in direct physical contact substantially over their entire length, in which the at least one second tube (20) has ends (32) spaced apart from ends (30) of the at least one first tube (18) so that the ends (30) of the at least one first tube (18) and the ends (32) of the at least one second tube (20) are received alternately in insertion holes (34) of a collection plate (38, 40) of the collection box (12, 14), and wherein the ends (30) of the at least one first tube (18) and the ends (32) of the at least one second tube (20) are spaced perpendicularly to the third fluid ($F_3$) passing through the core (16) and apart by a constant pitch (P).

2. A heat exchanger (10) according to claim 1, characterized in that the first tube (18) and/or the second tube (20) has a rectilinear body.

3. A heat exchanger (10) according to claim 1, characterized in that the ends (32) of the second tube (20) have a double bend.

4. A heat exchanger (10) according to claim 1, characterized in that the at least one collection box (12, 14) comprises a second distribution plate (46, 84) delimiting the second chamber (44) in communication with the second tubes (20) and comprising openings (80) for the ends (30) of the first tubes (18).

5. A heat exchanger (10) according to claim 4, characterized in that the second distribution plate (46, 84) forms a stop for the ends (32) of the second tubes (20).

6. A heat exchanger (10) according to claim 4, characterized in that the at least one collection box (12, 14) comprises a first distribution plate (50, 86) delimiting the first chamber (42) in fluid communication with the first tubes (18).

7. A heat exchanger (10) according to claim 6, characterized in that the first distribution plate (50, 86) forms a stop for the ends (30) of the first tubes (18).

8. A heat exchanger (10) according to claim 4, characterized in that the at least one collection box (12, 14) comprises a closing assembly (52) opposite the second distribution plate (46, 84).

9. A heat exchanger (10) according to claim 8, characterized in that the closing assembly (52) includes an intermediate plate (54) and a lid (56) covering the first distribution plate (50; 86) and jointly defining chambers for distributing the first fluid ($F_1$) in the first distribution plate (50; 86) according to a defined path.

10. A heat exchanger (10) according to claim 4, characterized in that the at least one collection box (12, 14) has a first inlet (26) and a first outlet (28) for the first fluid ($F_1$) communicating with the first chamber (42) through the collection plate (38, 40) and through the second distribution plate (46, 84).

11. A heat exchanger (10) according to claim 10, characterized in that the first inlet (26) and the first outlet (28) are arranged on the same collection box (12) and communicate with the first chamber (42) of the collection box (12) through openings (62, 64) of the collection plate (38) and through openings (66, 68) of the second distribution plate (46) of the collection box (12).

12. A heat exchanger (10) according to claim 10, characterized in that the first inlet (26) and the first outlet (28) are arranged on two collection boxes (12, 14) opposite one another and communicating with the respective first chamber (42) of the collection boxes (12, 14) through openings (62, 64) of the collection plate (38) and through openings (66, 68) of the respective second distribution plate (46) of the collection box (12, 14).

13. A heat exchanger (10) according to claim 4, characterized in that the collection box (12, 14) has a second inlet (70) and a second outlet (72) for the second fluid ($F_2$) communicating with the second chamber (44) through the collection plate (38, 40).

14. A heat exchanger (10) according to claim 13, characterized in that the second inlet (70) and the second outlet (72) are arranged respectively on two collection boxes (12, 14) opposite one another and communicating respectively with the second chambers (44) of the collection boxes (12, 14) through respective openings of the collection plates (38, 40).

15. A heat exchanger (10) according to claim 1, characterized in that the at least one collection box (12, 14) includes two rows of insertion holes (34) for the first tubes (18) and the second tubes (20).

16. A heat exchanger (10) according to claim 6, characterized in that the second distribution plate (46; 84) of the at least one collection box (12, 14) includes a longitudinal channel (76; 90) supplying second openings (78; 92) so as to define the second chamber (44), in which the second openings (78; 92) alternate with first openings (80; 94) for the first fluid ($F_1$), and in that the first distribution plate (50; 84) of the collection box (12, 14) includes openings (82; 98) for the first fluid (F1) communicating respectively with the openings (80; 94) for the ends (30) of the first tubes (18) of the second distribution plate (46; 84).

17. A heat exchanger (10) according to claim 1, characterized in that corrugated spacers (24) are placed between the modules (22) so as to increase the surface of heat exchange with the third fluid ($F_3$).

18. A heat exchanger (10) according to claim 1, characterized in that the heat exchanger (10) is an air conditioning evaporator and in that the first fluid ($F_1$) is a refrigerant, the second fluid ($F_2$) is a phase change fluid capable of storing heat, and the third fluid ($F_3$) is air.

19. A heat exchanger (10) according to claim 1, characterized in that the first tubes (18) and/or the second tubes (20) are multichannel tubes.

20. A heat exchanger (10) according to claim 1, wherein the larger faces of the first tube (18) and the second tube (20) are parallel to one another.

21. A heat exchanger (10) including at least one collection box (12, 14) delimiting a first chamber (42) for a first fluid ($F_1$) and a second chamber (44) for a second fluid ($F_2$), as well as a core (16) of tubes (18, 20) leading into the at least one collection box (12, 14) and comprising at least one first tube (18) communicating with the first chamber (42) of the collection box (12, 14) and at least one second tube (20) communicating with the second chamber (44) of the collection box (12, 14), in which the at least one first tube (18) is joined to the at least one second tube (20) to form a module (22) enabling an exchange of heat between the at least one first tube (18) and the at least one second tube (20), in which the core (16) includes at least two modules (22) stacked and spaced apart so as to enable a third fluid ($F_3$) passing through the core (16) of tubes (18, 20);

wherein the at least one first tube (18) and the at least one second tube (20) of the module (22) are in direct physical contact substantially over their entire length, in which the at least one second tube (20) has ends (32) spaced apart from ends (30) of the at least one first tube (18) so that the ends (30) of the first tube (18) and the ends (32) of the at least one second tube (20) can be received alternately in insertion holes (34) of the collection box (12, 14) spaced apart by a constant pitch (P), and wherein the collection box (12, 14) includes a collection plate (38, 40) in which the insertion holes (34) are provided for the at least one first and at least one second tube (18, 20), a first distribution plate (50, 86) delimiting the first chamber (42) in fluid communication with the at least one first tube (18), and a second distribution plate (46, 84) delimiting the second chamber (44) in communication with the at least one second tubes (20) and comprising openings (80) for the ends (30) of the at least one first tube (18), and wherein the second distribution plate (46; 84) of the collection box (12, 14) includes a longitudinal channel (76; 90) supplying second openings (78; 92) so as to define the second chambers (44), in which the second openings (78; 92) alternate with first openings (80; 94) for the first fluid ($F_1$), and in that the first distribution plate (50; 84) of the collection box (12, 14) includes openings (82; 98) for the first fluid (F1) communicating respectively with the first openings (80; 94) of the second distribution plate (46; 84).

22. A heat exchanger (10) according to claim 1, wherein the end (30) of the first tube (18) of the module (22) is received in an insertion hole (34) adjacent to another insertion hole (34) that receives the end (32) of the second tube (20) of the module (22).

* * * * *